US011472174B2

(12) United States Patent
Feygelman et al.

(10) Patent No.: US 11,472,174 B2
(45) Date of Patent: Oct. 18, 2022

(54) WETTING APPARATUS

(71) Applicant: HEWLETT-PACKARD DEVELOPMENT COMPANY, L.P., Spring, TX (US)

(72) Inventors: Alex Feygelman, Ness Ziona (IL); Mordechai Arenson, Ness Ziona (IL); Marko Richter, Ness Ziona (IL); Yossi Yaacobov, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 136 days.

(21) Appl. No.: 16/605,873

(22) PCT Filed: Dec. 14, 2017

(86) PCT No.: PCT/US2017/066369

§ 371 (c)(1),
(2) Date: Oct. 17, 2019

(87) PCT Pub. No.: WO2019/117914

PCT Pub. Date: Jun. 20, 2019

(65) Prior Publication Data

US 2021/0283897 A1 Sep. 16, 2021

(51) Int. Cl.
*B41F 31/28* (2006.01)

(52) U.S. Cl.
CPC ..... *B41F 31/28* (2013.01)

(58) Field of Classification Search
CPC ..... B41F 31/02; B41F 31/027; B41F 9/065; B05C 1/0813
USPC ..... 101/350.1
See application file for complete search history.

(56) References Cited

U.S. PATENT DOCUMENTS 3,976,004 A * 8/1976 England, III ..... B41F 19/02 101/26
4,625,643 A * 12/1986 Davis ..... B41F 31/027 101/169
6,109,746 A 8/2000 Jeanmaire et al.
(Continued)

FOREIGN PATENT DOCUMENTS

CN 1167680 12/1997
CN 101242906 8/2008
(Continued)

*Primary Examiner* — Leslie J Evanisko
*Assistant Examiner* — Leo T Hinze
(74) *Attorney, Agent, or Firm* — HP Inc. Patent Department

(57) ABSTRACT

There is disclosed apparatus for wetting a roller of a printing system comprising an applicator unit comprising a liquid agent chamber. Upper and lower walls extend from the liquid agent chamber to define a slit therebetween. The upper wall extends beyond a lip of the lower wall to a transfer lip. A flow restrictor is received in the slit to prevent flow of liquid agent to a respective portion of the transfer lip, thereby defining a restricted portion of the slit and an adjacent unrestricted portion of the slit. The flow restrictor fits in the restricted portion with a clearance that permits liquid agent flow at a reduced velocity relative flow through the unrestricted portion, such that liquid agent along the restricted portion is discharged from the lower wall. A method of installing a flow restrictor is also disclosed.

15 Claims, 7 Drawing Sheets

(56) References Cited

U.S. PATENT DOCUMENTS

| | | | | |
|---|---|---|---|---|
| 7,033,644 | B2 * | 4/2006 | Tokimasa | B05C 5/0254 118/410 |
| 7,169,229 | B2 | 1/2007 | Gibson et al. | |
| 9,468,946 | B2 | 10/2016 | Inamasu et al. | |
| 2002/0134263 | A1 | 9/2002 | Metrope | |
| 2004/0107852 | A1 * | 6/2004 | Tafel | B41F 31/08 101/350.1 |
| 2015/0283829 | A1 | 10/2015 | Gazit | |
| 2016/0354800 | A1 | 12/2016 | Birecki | |
| 2017/0036235 | A1 | 2/2017 | Feygelman et al. | |

FOREIGN PATENT DOCUMENTS

| | | | |
|---|---|---|---|
| CN | 103419484 | | 12/2013 |
| CN | 102529334 | | 10/2014 |
| DE | 102011103804 | | 1/2012 |
| JP | H05200346 | A | 8/1993 |
| WO | WO2016119857 | A1 | 8/2016 |
| WO | WO2016165740 | A1 | 10/2016 |

* cited by examiner

WETTING APPARATUS

BACKGROUND

In press printing, a liquid agent such as an ink, a coating or a primer is applied to a wettable surface of a roller, for example an anilox or gravure roller. An auxiliary roller may be provided to selectively wet portions of the roller. For example, the auxiliary roller may have radially-extending rubber portions that engage and wet selected portions of the roller.

BRIEF DESCRIPTION OF DRAWINGS

Examples will now be described, by way of non-limiting example, with reference to the accompanying drawings, in which.

DETAILED DESCRIPTION

Figure 1:
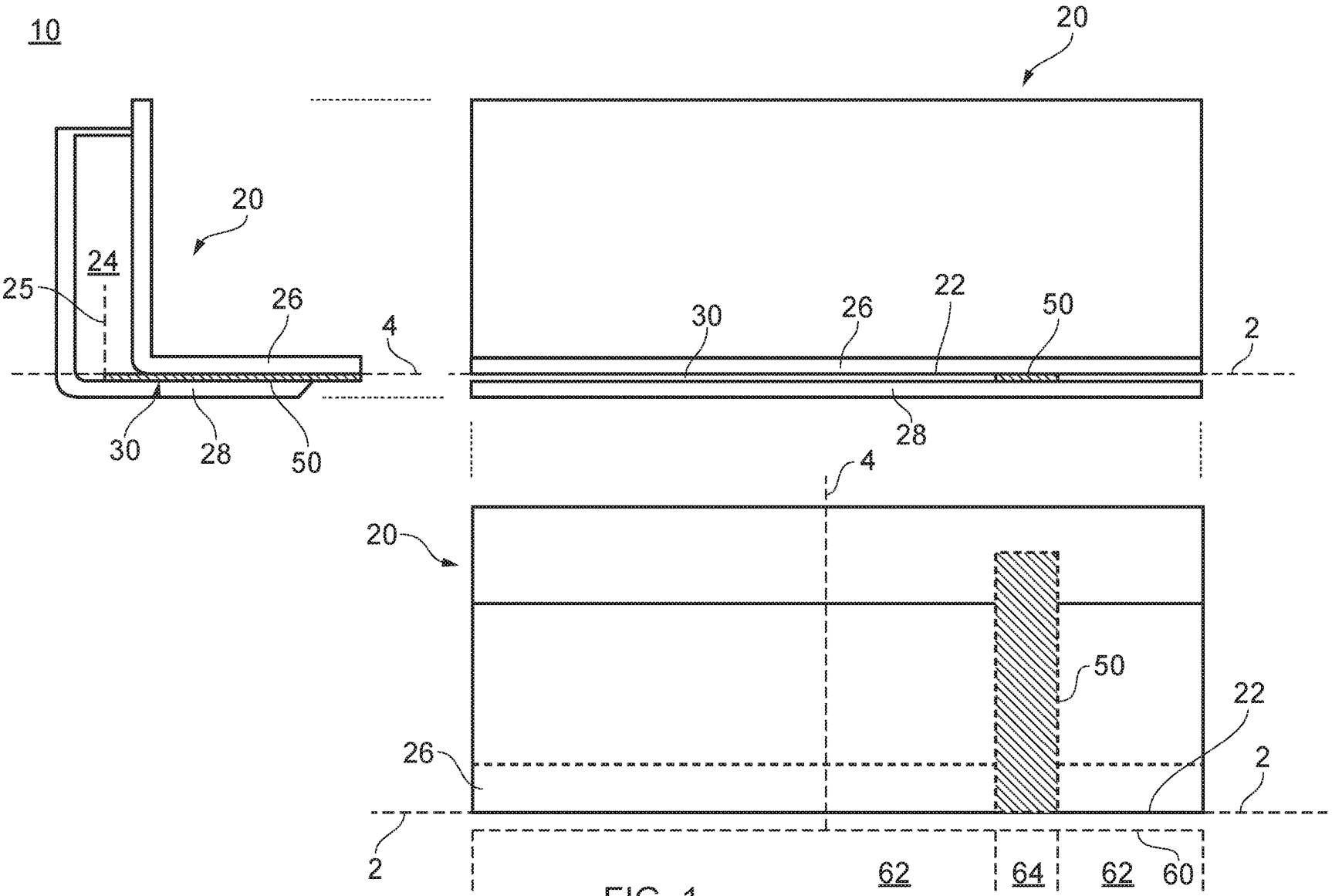
FIG. 1 is an orthographic projection of a simplified example wetting apparatus for wetting a roller of a printing system.

FIG. 1 shows an orthographic projection (front, side and plan view) of an example wetting apparatus 10 for applying a liquid agent onto a roller of a printing system.

The example wetting apparatus 10 comprises an applicator unit 20 which is generally elongate along a lateral axis 2 defined by a transfer lip 22 of the applicator unit for transferring liquid agent to a roller. In this example, the applicator unit 20 extends from a liquid agent chamber 24 at a rear side towards the transfer lip 22 at a front side along an application direction 4 substantially perpendicular to the lateral direction 2, corresponding to flow of liquid agent through the applicator unit 20 for transfer to a roller.

Upper and lower walls 26, 28 extend from the liquid agent chamber 24 to define a slit 30 between them for conveying liquid agent from the liquid agent chamber 24 to the transfer lip 22. In this particular example, the upper and lower walls 26, 28 are continuous with and extend from walls of the liquid agent chamber 24. For example, as shown in the side view, in this example the upper wall 26 extends from a lower end of an upright front wall of the liquid agent chamber 24 so that there is a curved join between them. Similarly, in this example the lower wall 28 extends from a lower end of an upright rear wall of the liquid agent chamber 24 so that there is a curved join between them.

By way of example, a height of the slit 30 (i.e. along a direction perpendicular to the upper wall 26 and towards the opposing lower wall 28) may be small as compared with its width (i.e. along the lateral direction 2) and depth (i.e. along the application direction 4). For example, the height of the slit 30 may be between 0.2-1 mm, for example 0.5 mm. The width of the slit may be between 500 mm and 1 m for example. The depth of the slit 30 may be 10 mm or more, such as 15 mm or more or 20 mm or more.

In this example, the upper wall 26 extends beyond a lip of the lower wall (i.e. it extends from the liquid agent chamber along the application direction 4) and terminates at the laterally extending transfer lip 22. In this particular example, the upper lip extends approximately 5 mm beyond the lip of the lower wall 28. The term lip is intended to denote the terminal edge of a wall that defines the slit 30.

In use, the applicator unit 20 receives a liquid agent, such as a primer or coating for a press print operation, in the liquid agent chamber 24. The liquid agent is provided to the slit under pressure so that it flows through the slit 30 along the application direction 4. In the absence of a blockage in the slit 30, the liquid agent may flow at a velocity such that it exits an aperture of the slit corresponding to the lip of the lower wall 28 and continues to flow along the upper wall 26 to reach the transfer lip 22, under action of surface tension forces. For example, the liquid agent may flow at a speed of approximately 1 m/s. From the transfer lip 22, the liquid agent may be transferred to an adjacent laterally-oriented roller rotating past the transfer lip 22 by forming a liquid bridge with a roller surface of the roller, as will be described below.

As shown in FIG. 1, in this example a flow restrictor 50 is received in the slit 30 to prevent flow of liquid agent to a respective lateral portion of the transfer lip 22, and thereby prevent such transfer to a respective lateral portion of an adjacent roller, as will be described in detail below.

In this particular example, the flow restrictor 50 is in the form of a cuboidal strip inserted into the slit 30 in an orientation so that it has a length along the application direction 4 greater than its width along the lateral direction 2. The flow restrictor 50 has a height along a direction corresponding to the height of the slit 30, and is dimensioned so that there is a clearance (i.e. in the height direction) between the flow restrictor 50 and the walls of the slit 30 when the flow restrictor 50 is received in the slit 30. For example, the clearance may be between 0.01 and 0.1 mm, for example between 0.01 and 0.03 mm. In the present disclosure a lateral portion of the slit 30 in which a flow restrictor is received is referred to as a restricted portion of the slit, as the presence of the flow restrictor restricts flow through the slit. In contrast, a lateral portion of the slit which is free of any flow restrictor is referred to as an unrestricted portion. The clearance between the flow restrictor 50 and the slit 30 permits liquid agent to flow along the respective restricted portion of the slit. The clearance may be such that flow of liquid agent is permitted along the restricted portion at a reduced rate relative a flow of liquid agent through an adjacent unrestricted portion. Accordingly, liquid agent flowing along the restricted portion is discharged from the lip of the lower wall 28, whereas liquid agent flowing along the unrestricted portion continues to flow along the upper wall 26 to reach the transfer lip 22 and be transferred to a roller. Accordingly, the flow restrictor 50 prevents flow of liquid agent to a respective lateral portion of the transfer lip 22, and therefore prevents liquid agent being transferred to a corresponding lateral portion of a roller.

Inserting a flow restrictor into the slit (i.e. along the application direction 4 through an aperture of the slit) may provide a particularly simple and convenient way of installing a flow restrictor. The length along which the slit 30 extends from the liquid agent chamber 24 along the application direction may be such that a flow restrictor installed therein may be securely retained. For example, in an apparatus having a slit height of approximately 0.5 mm, the slit 30 may extend at least 10 mm along the application direction, for example at least 15 mm or at least 20. In previously considered arrangements, a slit of an applicator may be insufficiently deep (i.e. along an application direction) to securely retain a flow restrictor inserted therein.

In some examples, a flow restrictor may be received in a slit so that a proximal end of the flow restrictor (i.e. the end farthest into the slit) abuts a wall, partition or other formation within the slit or liquid agent chamber. This may prevent a piston pressure being applied by pressurised liquid agent in the chamber onto the flow restrictor which may otherwise drive the flow restrictor out of the slit. An example such partition 25 is shown in dashed lines in the side cross-sectional view of FIG. 1. Such a partition may also provide a baffle for liquid agent received into the liquid agent chamber 24, for example so that liquid agent is provided to the slit 30 at a substantially constant velocity over unrestricted portions, independent of local proximity to an inlet of liquid agent to the chamber.

A portion of an example roller surface 60 of a roller is shown in dashed lines in the plan view of FIG. 1. In this example, the roller is cylindrical and rotatable around a roller axis parallel with the lateral direction 2, such that the roller surface 60 is spaced apart from the transfer lip by a uniform distance along its lateral extent for transfer of liquid agent, for example 2 mm. The example roller surface 60 has two wetted zones 62 corresponding to unrestricted portions of the slit 30, and an un-wetted zone 64 corresponding to the restricted portion of the slit 30 where the flow restrictor 50 is received, with lateral boundaries between the zones 62, 64 being indicated with dashed lines.

In some examples, a flow restrictor may be provided with a boundary guide adjacent the transfer lip (i.e. when the flow restrictor is installed/received in the slit) to define a lateral boundary of a wetted zone on a roller.

Figure 2:
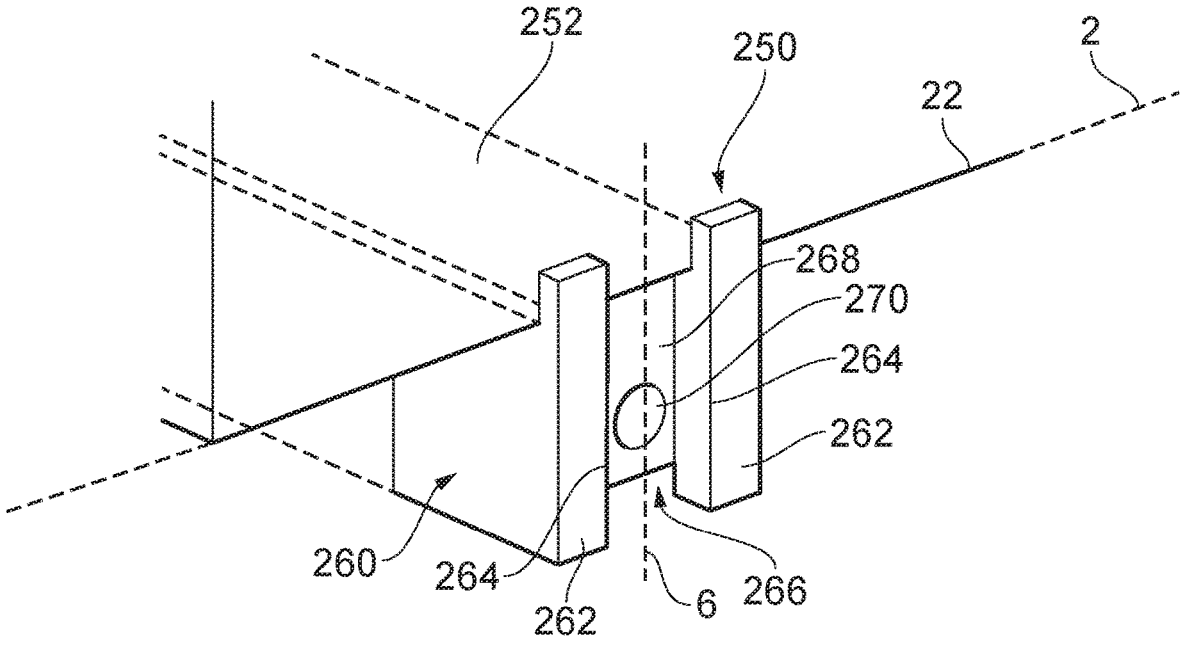
FIGS. 2-3 are perspective views of example boundary guides.

An example flow restrictor 250 including an insert portion 252 and a boundary guide 260 is shown in FIG. 2. In this example, the boundary guide 260 is provided at an end of the insert portion 252 which is to be received in a slit, so that the boundary guide is disposed outside of the slit. In this example, the boundary guide 260 is fixedly attached and suspended from an end of the insert portion so at least a portion of it lies beneath the portion of the upper wall 26 that extends beyond the lip of the lower wall 28. A front portion of the boundary guide 260 (i.e. a portion farthest from the slit along the application direction) defines a boundary surface 262 that extends along the lateral direction 2 and a guide direction 6 perpendicular to the lateral direction to oppose a roller surface of a roller. The boundary surface is to receive liquid agent, for example liquid agent that may flow along a portion of the upper wall 28 adjacent the flow restrictor 50 under capillary action forces and flow over walls of the boundary guide 260 to reach the boundary surface.

The boundary surface 262 may terminate at a boundary edge 264 extending perpendicular to the lateral direction 2 (e.g. along the guide direction 6) to prevent lateral migration of liquid agent on the boundary surface 262 beyond the boundary edge 264, and thereby define a lateral boundary of a wetted zone on the roller as will be described below. In particular, surface tension forces at the boundary edge 264 may be such that liquid agent received there is more readily transferred to an adjacent roller surface than laterally migrated over the boundary edge 264. Accordingly, the boundary edge 264 may thereby define a boundary between an un-wetted zone and a wetted zone on a roller.

A portion of the boundary guide 260 may extend in front of the transfer lip 22 so that in use it is disposed between the transfer lip 22 and a roller surface as shown in FIG. 2. Further, a portion of the boundary guide 260 may extend above the transfer lip 22 with respect to the guide direction 6. By extending above the transfer lip 22, the boundary guide may prevent lateral migration of liquid agent along a pathway above the transfer lip, for example an overflow pathway which may extend from the upper wall 28 around the transfer lip 22.

The boundary guide 260 may be integral with an insert portion 252 of the flow restrictor 250, or may be provided as a discrete element fixedly attached to the insert portion 252. In the example shown in FIG. 2, the boundary guide 260 is a discrete element fixedly attached to the insert portion 252. The boundary guide 260 and insert portion 252 may have different material compositions. For example, the insert portion 252 may comprise spring steel and the boundary guide may comprise PTFE or a PTFE coating. A portion of a flow restrictor which is to be received in a slit may comprise a material resistant to corrosion in the liquid agent, for example stainless steel, which has good corrosive resistance to high PH liquids, such as primers and coatings as may be used in press printing.

In the example shown in FIG. 2, the boundary guide 260 comprises two boundary surfaces 262 terminating at respective boundary edges 264 laterally spaced apart by a void 266. Providing a void adjacent the boundary edges 264 may prevent lateral migration of liquid agent on the boundary surfaces 262 beyond the boundary edge 264. Accordingly, the boundary edge 264 may thereby define an un-wetted zone on the roller corresponding to the void as will be illustrated in the further figures.

In the example boundary guide 250 shown in FIG. 2, there is an intermediate portion 268 laterally between the two boundary surfaces 262. The boundary surfaces 262 are disposed forward of the intermediate portion 268 with respect to the application direction from the slit to a roller (which may be equally referred to as from the slit to the transfer lip). The arrangement of the boundary surfaces 262 and the intermediate portion 268 is such that the intermediate portion 268 is recessed between the boundary surfaces 266 (i.e. the void is in front of the intermediate portion 268). The intermediate portion 268 may comprise a locating formation 270 to cooperate with a corresponding locating feature of an apparatus for placement of the flow restrictor 250, i.e. for placement of the flow restrictor 250 in and along the slit, as will be described below. In this particular example, a locating formation 270 is provided as a recess in the intermediate portion 268, in particular a cylindrical recess 270 for receiving a corresponding cylindrical locating pin. However, in other examples the locating formation 270 may take any appropriate form, for example a differently shaped recess or protrusion.

Figure 3:
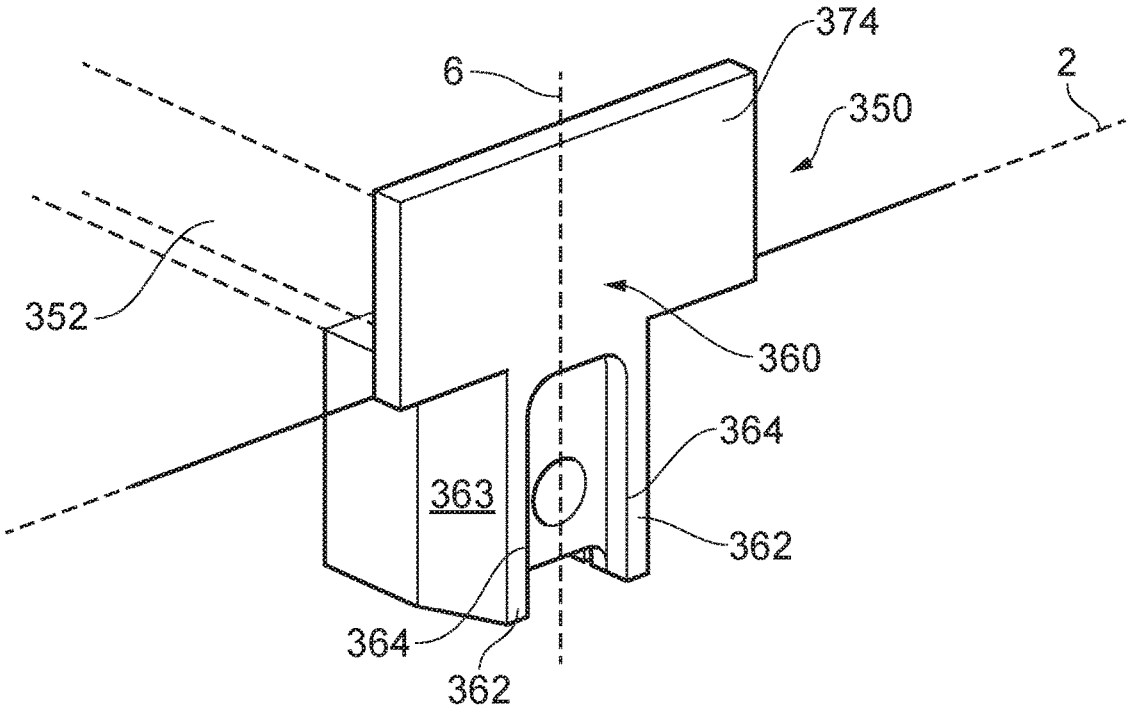

FIG. 3 shows a further example flow restrictor 350 for use with the applicator unit of FIG. 1, which is similar to the flow restrictor 250 of FIG. 2 but differing with respect to the boundary surface 362 and profile of the boundary guide 360. The boundary guide 360 is provided at an end of an insert portion 352 as described above with respect to FIG. 2, and is suspended from it so that at least a portion of it lies beneath the portion of the protruding part of the upper wall 26 that extends beyond the lip of the lower wall 28, as above.

In this example, the boundary guide 360 has chamfered forward edges 363 to guide liquid agent along side surfaces of the boundary guide 360 towards forward boundary surfaces 362 that are to oppose a roller. In this example, the boundary guide 360 comprises two parallel boundary surfaces 362 extending along a guide direction 6 perpendicular to the lateral direction 2, and terminating at boundary edges 364 laterally spaced apart by a void 366 as described above. The boundary guide 360 further comprises an upper boundary surface 374 which is to extend above and in front of the transfer lip 22 when the flow restrictor 350 is received in the slit of an applicator unit. The upper boundary surface 374 is to prevent lateral migration of liquid agent along a pathway extending above the transfer lip, for example an overflow pathway as described above. In this particular example, the upper boundary surface 374 extends laterally to bridge the two parallel boundary surfaces 362 at its lower side, and extends upwardly away from the transfer lip 22 to provide a barrier to liquid agent that may otherwise flow from the upper wall 26 up and over a portion of the boundary guide 350. In this example, the upper boundary surface 374 is generally rectangular. The upper boundary surface 374 has a greater lateral extent than the two parallel boundary surfaces 362 together to prevent overflow from adjacent lateral portions of the upper wall 26.

As with the flow restrictor 250 of FIG. 2, in this example the boundary guide 360 is discrete from the insert portion 352 and fixedly attached to it.

Figure 4:
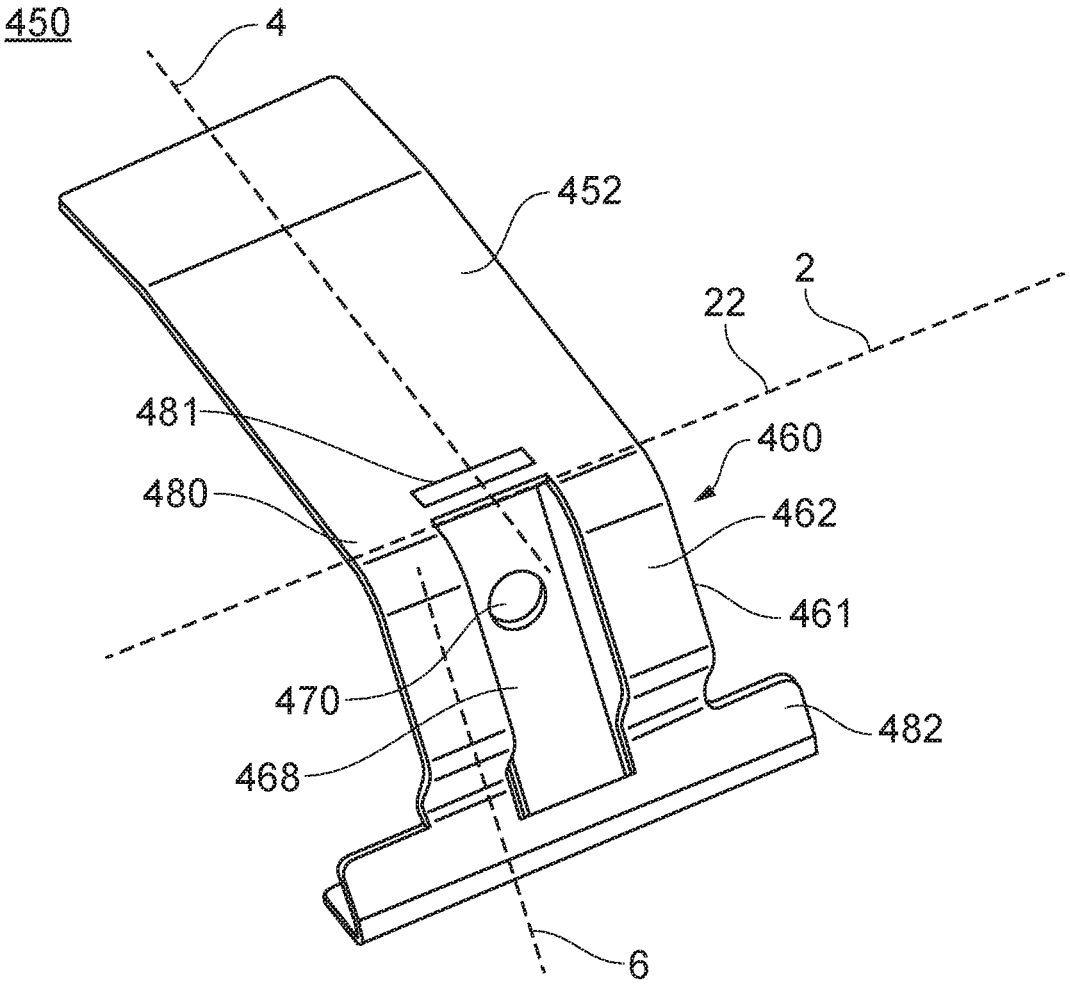
FIG. 4 is a perspective view of an example flow restrictor.

FIG. 4 shows a further example of a flow restrictor 450 for use with the applicator unit of FIG. 1, as illustrated with reference to a location of a transfer lip 22 (shown with a dashed line) when the flow restrictor 450 is installed in the slit of the applicator unit of FIG. 1. In this particular example, the flow restrictor 450 comprises an insert point 452 and a boundary guide 460 which are integrally formed with one another. However, in other examples, they may be discrete from one another.

In this example, the insert portion 452 is biased away from a planar configuration for retention in a slit. In particular, as shown in FIG. 4, an end region of the insert portion 452 is deflected away from the plane of a center region of the insert portion about a hinge line. This bias may cause the insert portion to apply a biasing force on opposing surfaces of a slot in which it is received, which may provide for an increased frictional force resisting dislodging of the insert portion within the slot.

The boundary guide 460 comprises two rails 461 defining respective boundary surfaces 462 which extend along a lateral direction 2 parallel with the transfer lip 22 and a guide direction 6 which is perpendicular to the lateral direction. The two rails 461 extend along the guide direction 6 from a lip portion 480 of the boundary guide 460 adjacent the lip 22 (e.g. at the junction between the boundary guide 460 and the insert portion) to a distal support portion 482. The distal support portion 482 is to rest against a support structure of the apparatus of FIG. 1, as will be described below.

In this example, the distal support portion 482 comprises a laterally extending member which has a greater lateral extent than the rails 461 (when considered together). Increasing the lateral extent of the support portion 482 may provide increased stability to the location of the flow restrictor 450 in the slot, as it may provide increased resistance to rotation of the flow restrictor 450 within the slot.

In this particular example, the boundary guide 460 further comprises an intermediate portion 468 laterally between the rails 461 and recessed relative the rails 461 with respect to the application direction, so that in use the intermediate portion 468 is spaced further from a roller than the rails 461. The intermediate portion 468 may extend between the lip portion 480 of the boundary guide 460 adjacent to the transfer lip 22 to the distal support portion 482. In some examples, the intermediate portion 468 may be integrally attached to the distal support portion and may be affixed to the lip portion 480, for example by being received in a slot in the lip portion 481 and optionally secured therein (for example by welding, by deformation of a protruding part of the intermediate portion beyond the slot, or by a mechanical fastener). Providing the rails forward of the intermediate of the intermediate portion may provide structural rigidity to the boundary guide 460.

In this particular example, the intermediate portion 468 comprises a locating formation 470 to cooperate with a corresponding locating feature of an apparatus for placement of the flow restrictor 450. The example locating formation 470 comprises a circular hole in the intermediate portion 468 which may receive a locating pin as will be described below.

The insert portion 452 may be integrally formed with the boundary guide 460. In the particular example shown in FIG. 4, the insert portion 452 and the boundary guide 460 are integrally formed as a unitary body, for example from a sheet material. A particular example may be sheet metal such as spring steel. In the sheet material body, the intermediate portion may be punched or otherwise separated from the rails on three sides so that it is cantilever-mounted to one of the lip portion 480 and the distal support portion 482, and may be affixed to the opposing one of the lip portion 480 and the distal support portion 482. In the particular example shown in FIG. 4, the intermediate portion 468 is cantilever-mounted to the distal support portion 482 and affixed to the lip portion 480 by being received in a slot 481 in the lip portion. A slot 481 in the lip portion may be punched or laser cut, for example.

Figure 5:
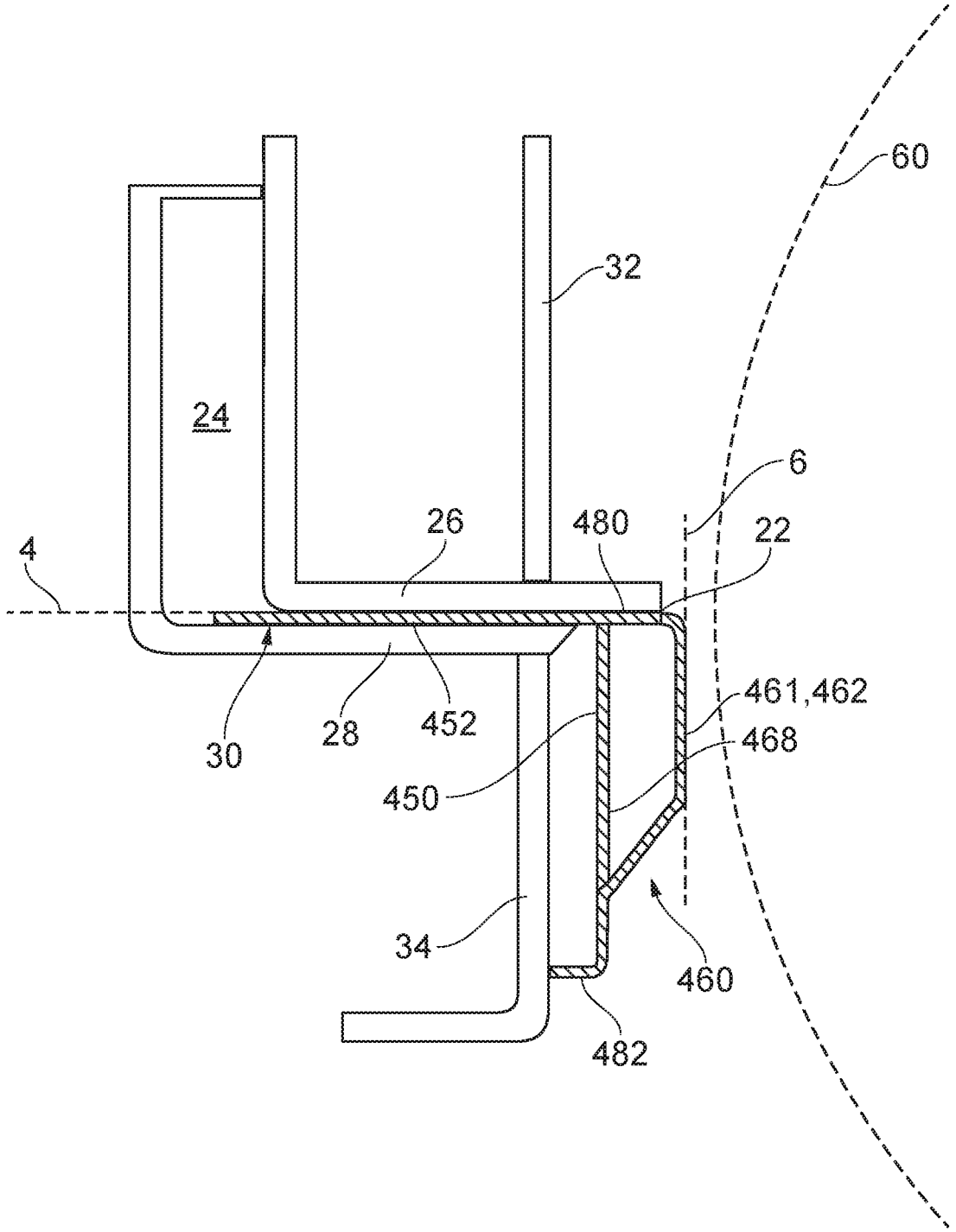
FIG. 5 is a side cross sectional view of an example wetting apparatus.

FIG. 5 shows the example flow restrictor 450 of FIG. 4 as installed in a slot 30 of the applicator unit 20 of FIG. 1. The applicator unit comprises a slit 30 defined between upper and lower walls 26, 28 which extend from a liquid agent chamber 24 as described above. The applicator unit 20 may further comprise support structure adjacent an aperture of the slit 30. In the particular example shown in FIG. 5, there is a support structure comprising an upper support wall 32 and an opposing lower support wall 34 which engage the upper and lower walls 26, 28 on upper and lower sides respectively. The support structure may provide a reinforcing support to the upper and lower walls 26, 28 and thereby maintain dimensional accuracy of the aperture of the slot a 30 from which liquid agent is discharged.

As shown, the insert portion 452 is received in the slot 30 and the boundary guide 460 is disposed outside of the slot. The flow restrictor 450 is bent at the lip portion 480 so that the rails 461 extend below the transfer lip 22 of the upper wall 26 along a guide direction 6 so that the boundary surfaces 462 may oppose a roller. A roller surface 60 of an example roller is depicted in dashed lines by way of example only. In this example, the guide direction 6 is perpendicular to the lateral direction and approximately perpendicular to the application direction 4.

As shown in FIG. 5, each of the rails 461 and the intermediate portion 468 extend form the lip portion 480 to the distal portion 482, with the rails 461 being disposed forward of the intermediate portion 468 with respect to the application direction 4. In this particular example the distal support portion 482 extends towards the applicator unit 20 to rest against a support structure of the applicator unit 20—in this particular example against the lower support wall 34. However, in other examples, the distal support portion 482 may rest against any other component of an applicator unit 20 or a component fixed with respect to it.

Figure 6:
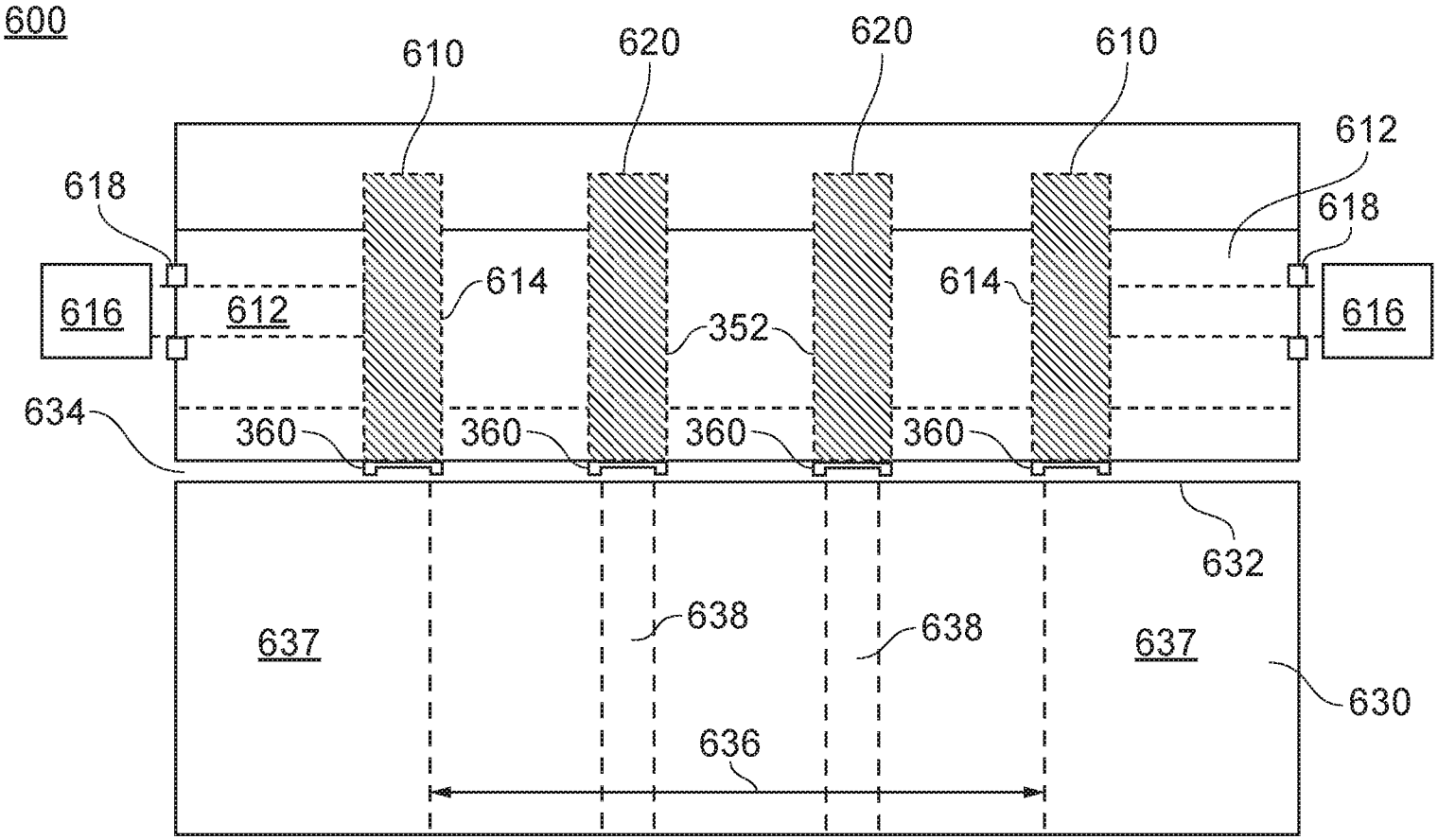
FIG. 6 is a plan view of an example wetting apparatus and roller of a printing apparatus with hidden view detail.

FIG. 6 shows an example apparatus 600 comprising an example applicator unit 20 as described above and a plurality of example flow restrictors 610, 620, together with an example roller 630 having a roller surface 632 which opposes the transfer lip 22 of the applicator unit 20 over a transfer gap 634. In this example, the flow restrictors 610, 620 comprise two flow limiters 610 disposed towards opposing lateral sides of the slot 30 which define lateral boundaries of a total wetted zone 636 of the roller 630 (i.e. the cumulative lateral extent over which any portion of the roller is wetted by liquid agent transfer from the applicator unit). The flow restrictors 610, 620 further comprise two lane inserts 620 at intermediate locations in the slot (i.e. intermediate with respect to the lateral extent of the slot over which liquid agent is to be discharged) to define corresponding dry lanes 638 on the roller surface 632.

In other examples, an apparatus may comprise a flow limiter 610 with no lane inserts 620, and similarly an apparatus may comprise a lane insert 620 with no flow limiters.

Any suitable form of a flow restrictor may be used for each of the flow limiters 610 and lane inserts 620, for example, the flow limiters and lane inserts may be in accordance with any of the example flow restrictors 250, 350, 450 as described herein.

In this particular example, each of the flow limiters 610 and lane inserts 620 comprise flow restrictors in accordance with the example flow restrictor 350 described above with respect to FIG. 3, and thereby comprise an insert portion 352 and a discrete boundary guide 360 which is at least partly disposed between the transfer lip 22 and the roller surface 632.

A flow limiter 610 may be moveable along the lateral direction to vary a lateral position of a boundary of the total wetted zone 636. A flow limiter 610 may comprise or be provided with any suitable actuation arrangement for moving the flow limiter 610 along the lateral direction.

In the particular example apparatus 600 of FIG. 6, each flow limiter comprises an arm portion 612 which extends laterally into the slit 30 from a respective lateral end of the slit 30, and a tab portion 614 extending from the arm portion 612 towards the transfer lip 22 which corresponds to a flow restrictor as described with respect to any of the above examples, for example the flow restrictor 350 described above with respect to FIG. 3

In this particular example, the arm portion 612 and the tab portion 614 are received in the slot 30 with a clearance so that they define a corresponding restricted portion of the slit as described above. The arm portion 612 extends through a seal 618 and outside of the slit 30 to engage a drive 616 for driving lateral movement of the flow limiter 610. For example, the drive 616 and arm portion 612 may engage by a rack and pinion arrangement or any other suitable actuation arrangement. For example, when a rack and pinion arrangement is used, the arm portion 612 may comprise an array of drive holes along its length and the drive 616 may comprise a drive wheel provided with drive projections for engaging the drive holes. The drive may comprise a worm screw. The drive 616 may comprise a stepper motor or other suitable actuation device. The drive arrangement may comprise a linear encoder, which may be to provide a signal indicating an absolute lateral position of the flow limiter. Accordingly, the lateral position may be derived and controlled irrespective of any intervening power down of the apparatus.

In this example, each drive 616 is disposed outside of the liquid agent chamber 24 and outside of the slit 30. Accordingly, each drive 616 may be separate from and not immersed in the liquid agent in use. In previously considered arrangements, a drive may be disposed in a liquid agent chamber or otherwise exposed to it. Liquid agent may be damaging to components of a drive.

In use, the drive 616 may be operated to move the flow limiter 610 along the lateral direction to thereby move the lateral location of a respective boundary of a total wetted zone 636 on the roller surface 632. In use, liquid agent is caused to flow through the slot 30 along the application direction 4. In a restricted portion of the slot 30 corresponding to the location of the arm portion 612 and tab portion 614, the liquid agent flows at a reduced velocity relative a flow of liquid agent through an adjacent unrestricted portion between the flow limiter 610 and any corresponding flow restrictor (e.g. a flow limiter 610 or lane insert 620). The reduced velocity is such that the liquid agent is discharged from the lip of the lower wall of the slit, rather than flowing along the upper wall to reach the transfer lip 22 for transfer to the roller 630. For example, the reduced velocity may be XXm/s, whereas a velocity through an unrestricted portion of the slit may be approximately 1 m/s. Accordingly, a lateral end portion of the roller 630 from an extreme end of the roller up to the boundary of the wetted zone 636 does not receive liquid agent in use, and is thereby referred to as an un-wetted end zone 637 herein. In contrast, liquid agent flowing along an unrestricted portion of the slit reaches a corresponding lateral portion of the transfer lip 22 and is thereby transferred to a wetted zone of the roller surface 632.

Similarly, in use each lane insert 620 defines a corresponding restricted portion of the slot 30 which prevents a flow of liquid agent to a corresponding lateral portion of the transfer lip 22 in the same way.

In this particular example, the flow restrictors are in accordance with the example flow restrictor described above with respect to FIG. 3, and accordingly are provided with boundary guides which have boundary surfaces to face the roller, and which define boundary edges extending perpendicular to the lateral direction to prevent lateral migration of liquid agent along the boundary surface beyond the boundary edge. As shown in FIG. 6, in this example the boundary guides have an overall width corresponding to the width of the respective insert portion, and the boundary surface opposes the roller 630 so that in this example the boundary edges are laterally inset within the overall width of the boundary guide. As the boundary edges define the lateral boundaries of a corresponding un-wetted dry lane 638 on the roller surface 632 (at least in this example), the un-wetted dry lane 638 has a lateral extent less than the width of the respective insert portion.

Figure 7:
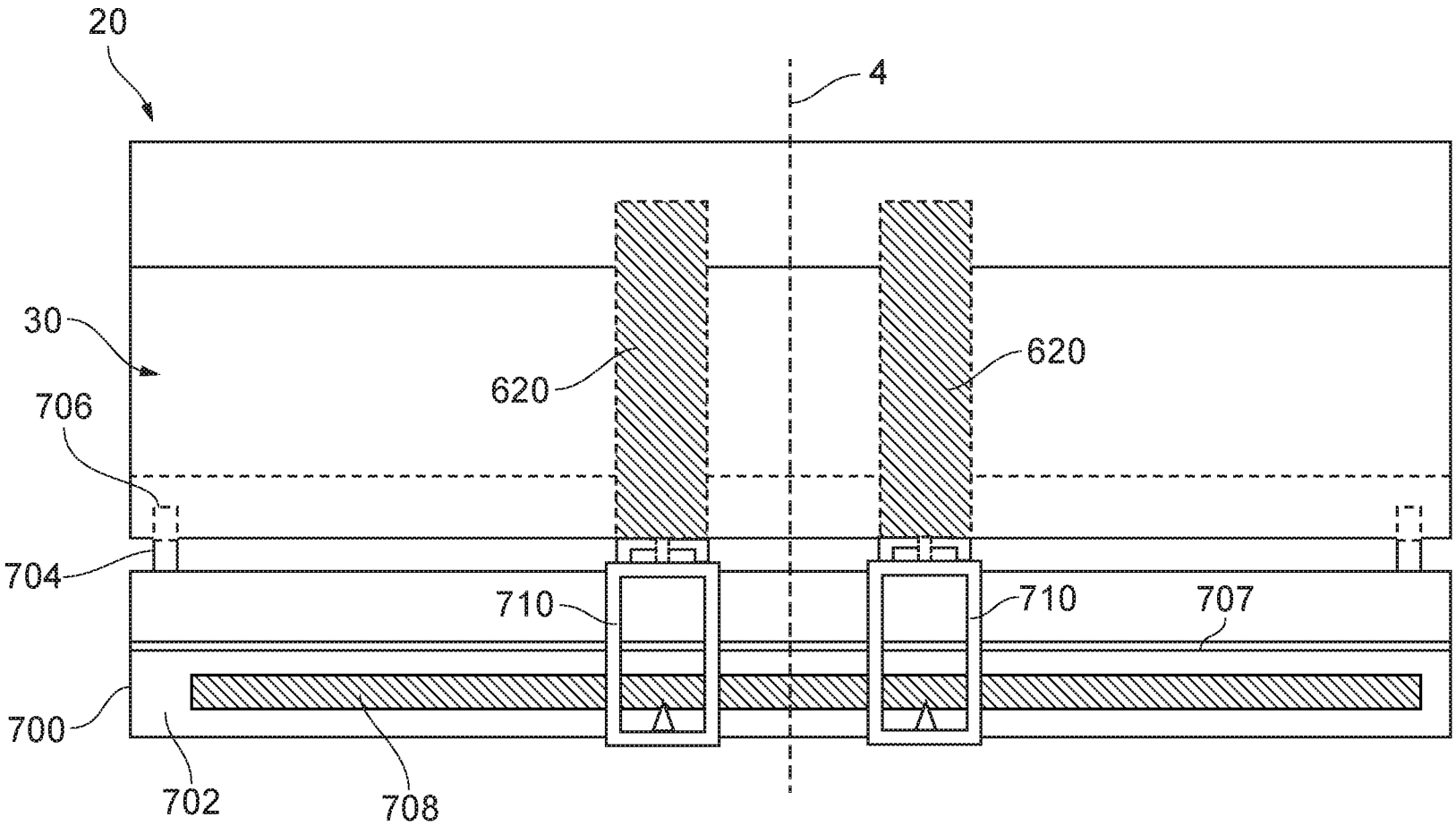
FIG. 7 is a plan view of an example wetting apparatus and insert jig with hidden view detail.

FIG. 7 shows an example applicator unit 20 as described above with respect to FIG. 1 in plan view with hidden detail relating to the insertion of example insert tabs 620 into the slot 30 of the applicator unit 20. The example insert tabs 620 are as described above with respect to FIG. 6. FIG. 7 shows an example insert jig 700 for aligning a flow restrictor such as an insert tab 620 with a predetermined lateral position along the slit 30 (i.e. a predetermined lateral position along the applicator unit 20). FIG. 7 shows the applicator unit 20 with insert tabs 620 received in the slit 30 of the applicator unit 20. For example, the insert tabs 620 may be inserted into the slit 30 before the insert jig is aligned with the applicator unit 20. In this example, the insert jig comprises a support body 702. The insert jig 700 and the applicator unit 20 have cooperating formations 704, 706 respectively for aligning the jig with a predetermined lateral location with respect to the applicator unit. For example, the cooperating formations 704, 706 may comprise corresponding laterally-spaced apart pairs of projections and recesses. In the example shown in FIG. 7, the insert jig comprises protruding alignment pins and the applicator unit 20 comprises cooperating alignment recesses.

The insert jig 700 further comprises a restrictor guide 710. In the example shown in FIG. 7, there are two restrictor guides 710 for aligning two respective flow restrictors. Each restrictor guide 710 is laterally slidable along the insert jig 700 and is to cooperate with a corresponding flow restrictor 620, for example by cooperating locating formations 712, 270. The cooperating locating formations may be a locating pin protruding from the restrictor guide 710 towards the flow restrictor along the application direction 4 and a cooperating locating hole 270 in the flow restrictor 620 to receive the locating pin. Example locating holes 270, 370, 470 are described with respect the flow restrictors of FIGS. 2-4 respectively.

Each restrictor guide 710 is to slide laterally along the insert jig to drive corresponding sliding movement of the respective flow restrictor within the slot 30. In this particular example, the insert jig comprises a rail 707 on which each of the restrictor guides 710 are slidably mounted.

In this particular example, the insert jig 700 further comprises a laterally-extending marking scale 708, such as ruler markings. The marking scale 708 may indicate alignment positions for a flow restrictor with respect to the slit 30 when the insert jig is aligned with the applicator unit.

Figure 8:
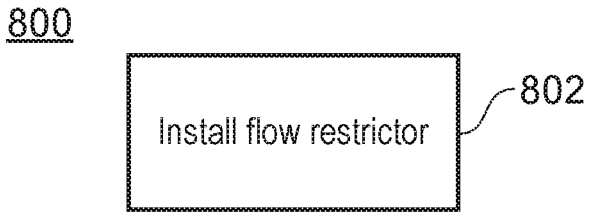
FIG. 8 is a flowchart of an example method of installing a flow restrictor.

FIG. 8 is a flowchart of an example method of installing a flow restrictor in a wetting apparatus which may be in accordance with any of the examples described herein. The wetting apparatus comprises an applicator unit having a liquid agent chamber, upper and lower walls extending from the liquid agent chamber to define a slit between them for conveying liquid agent, the slit having a width along a lateral direction; wherein the upper wall extends beyond a lip of the lower wall and terminates at a laterally extending transfer lip to transfer liquid agent conveyed along the upper wall from the slit to a roller.

In block 802, a flow restrictor is installed in the slit to prevent flow of liquid agent to a respective lateral portion of the transfer lip, thereby defining a restricted portion of the slit and an adjacent unrestricted portion of the slit. The flow restrictor is installed so that there is a clearance between the flow restrictor and the slit which permits liquid agent to flow along the restricted portion at a reduced velocity relative a flow of liquid agent through the unrestricted portion, such that liquid agent flowing along the restricted portion is discharged from the lip of the lower wall.

Figure 9:
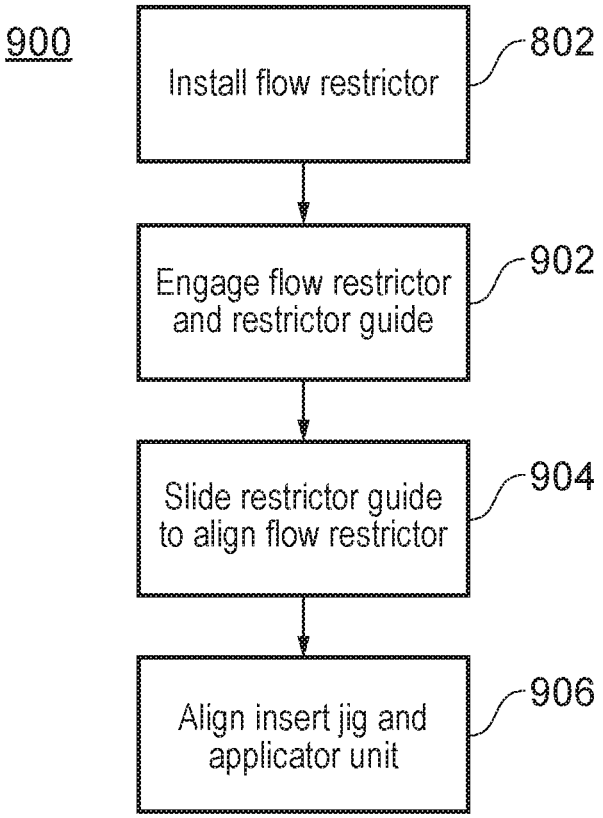
FIG. 9 is a flowchart of a further example method of installing a flow restrictor.

FIG. 9 shows a further example method including aligning the flow restrictor with the slit using an insert jig, such as an insert jig as described with respect to FIG. 7 above. In block 802, the flow restrictor is installed in the slot as described above. In this example, there is a predetermined lateral location for the flow restrictor and the flow restrictor is not in the predetermined location after initial insertion. In block 902, cooperating locating features on the flow restrictor and a restrictor guide of the insert jig are engaged to align the flow restrictor with the restrictor guide. In block 904, the restrictor guide is slid to align the flow restrictor relative the insert jig. In this particular example, the insert jig includes markings corresponding particular locations along the slit. For example, the insert jig may include ruler-style markings The restrictor guide is slid along the insert jig to align a marking feature of the restrictor guide with a predetermined location on the insert jig markings, for example a predetermined lateral location for the insert jig. In block 906, the insert jig is aligned with the applicator unit. By conducting blocks 802, 902, 904, 906 (in any order), the flow restrictor becomes aligned with a predetermined lateral position along the slit (i.e. along the applicator unit).

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. Apparatus for wetting a roller of a printing system, the apparatus comprising:
   - an applicator unit comprising:
   - a liquid agent chamber;
   - upper and lower walls extending from the liquid agent chamber to define a slit between them for conveying liquid agent, the slit having a width along a lateral direction;
   - wherein the upper wall extends beyond a lip of the lower wall and terminates at a laterally extending transfer lip to transfer liquid agent conveyed thereto to a roller;
   - a flow restrictor received in the slit to prevent flow of liquid agent to a respective lateral portion of the transfer lip, thereby defining a restricted portion of the slit and an adjacent unrestricted portion of the slit;
   - wherein there is a clearance between the flow restrictor and the slit which permits liquid agent to flow along the restricted portion at a reduced velocity relative a flow of liquid agent through the unrestricted portion, such that liquid agent flowing along the restricted portion is discharged from the lip of the lower wall.

2. Apparatus according to claim 1, wherein the flow restrictor comprises a boundary guide adjacent the transfer lip to define a lateral boundary of a wetted zone on a roller;
   - wherein the boundary guide comprises a boundary surface to receive liquid agent, the boundary surface extending along the lateral direction and a guide direction perpendicular to the lateral direction to oppose a roller; and
   - wherein the boundary surface terminates at a boundary edge extending perpendicular to the lateral direction to prevent lateral migration of liquid agent on the boundary surface beyond the boundary edge and thereby define a lateral boundary of a wetted zone on the roller.

3. Apparatus according to claim 2, wherein the boundary guide comprises two boundary surfaces terminating at respective boundary edges laterally spaced apart by a void to prevent lateral migration of liquid agent on the boundary surfaces beyond the boundary edges, and thereby define an un-wetted zone on the roller corresponding to the void.

4. Apparatus according to claim 3, wherein the boundary guide comprises an intermediate portion laterally between the two boundary surfaces, the two boundary surfaces being disposed forward of the intermediate portion with respect to an application direction from the slit to a roller;

wherein the intermediate portion comprises a locating formation to cooperate with a corresponding locating feature of an apparatus for placement of the flow restrictor.

5. Apparatus according to claim 4, wherein a portion of the boundary guide extends above the transfer lip and in front of the transfer lip with respect to the application direction.

6. Apparatus according to claim 4;

wherein the boundary guide comprises two rails defining the boundary surfaces, the rails extending from a lip portion of the boundary guide adjacent the lip to a distal support portion;

wherein the distal support portion is to rest against a support structure of the apparatus; and wherein the rails are profiled so that the boundary surfaces are disposed forward of the intermediate portion; and wherein the intermediate portion is integral with the support portion and affixed to the lip portion.

7. Apparatus according to claim 2, wherein the flow restrictor comprises a slit portion received in the slit; and wherein the slit portion and the boundary guide are integrally formed.

8. Apparatus according to claim 7, wherein the boundary guide comprises two rails defining the boundary surfaces, the rails extending from a lip portion of the boundary guide adjacent the lip to a distal support portion;

wherein the distal support portion is to rest against a support structure of the apparatus; and wherein the rails are profiled so that the boundary surfaces are disposed forward of an intermediate portion; and wherein the intermediate portion is integral with the support portion and affixed to the lip portion.

9. Apparatus according to claim 1, wherein the flow restrictor is a format limiter to prevent flow of liquid agent to an end portion of the transfer lip, thereby defining a lateral boundary of a total wetted zone on a roller.

10. Apparatus according to claim 9, wherein the format limiter comprises:

an arm portion extending laterally into the slit from a lateral end of the slit; and a tab portion extending from the arm portion towards the transfer lip, whereby the arm portion and the tab portion define a corresponding restricted portion of the slit; and wherein the apparatus further comprises a drive for laterally moving the format limiter to vary the boundary of the total wetted zone.

11. Apparatus according to claim 10, further comprising a seal; and wherein the drive is disposed outside of the chamber and outside of the slit, and wherein the arm portion extends through the seal to engage the drive.

12. Apparatus according to claim 1, wherein the flow restrictor is a lane insert to prevent flow of liquid agent to an intermediate dry portion of the transfer lip, to thereby form a corresponding dry lane on a roller.

13. Apparatus according to claim 12, wherein the lane insert comprises an insert portion received in the slit which is biased away from a planar configuration for retention in the slit.

14. A method of installing a flow restrictor in a wetting apparatus comprising:

an applicator unit having a liquid agent chamber, upper and lower walls extending from the liquid agent chamber to define a slit between them for conveying liquid agent, the slit having a width along a lateral direction; wherein the upper wall extends beyond a lip of the lower wall and terminates at a laterally extending transfer lip to transfer liquid agent conveyed along the upper wall from the slit to a roller;

the method comprising:

installing a flow restrictor in the slit to prevent flow of liquid agent to a respective lateral portion of the transfer lip, thereby defining a restricted portion of the slit and an adjacent unrestricted portion of the slit;

wherein there is a clearance between the flow restrictor and the slit which permits liquid agent to flow along the restricted portion at a reduced velocity relative a flow of liquid agent through the unrestricted portion, such that liquid agent flowing along the restricted portion is discharged from the lip of the lower wall.

15. A method according to claim 14, further comprising aligning the flow restrictor with the slit using an insert jig by:

engaging cooperating locating features on the flow restrictor and a restrictor guide of the insert jig;

sliding the restrictor guide to align the flow restrictor relative the insert jig; and aligning the insert jig with the applicator unit.

* * * * *